United States Patent [19]

Böhringer

[11] Patent Number: 4,899,942

[45] Date of Patent: Feb. 13, 1990

[54] JAW CRUSHER

[76] Inventor: Paul Böhringer, Heuchlingerstrasse 35, D-7101 Oedheim, Fed. Rep. of Germany

[21] Appl. No.: 303,918

[22] Filed: Jan. 31, 1989

[30] Foreign Application Priority Data

Feb. 5, 1988 [DE] Fed. Rep. of Germany ..... 3803496

[51] Int. Cl.[4] ..... B02C 1/10

[52] U.S. Cl. ..... 241/200; 241/265; 241/266

[58] Field of Search ..... 241/200, 300, 264–269, 241/32, 245, 285 R, 285 A, 285 B

[56] References Cited

U.S. PATENT DOCUMENTS

| | | | |
|---|---|---|---|
| 1,364,531 | 1/1921 | Trottier . | |
| 2,843,329 | 7/1958 | Matthews . | |
| 3,959,897 | 6/1976 | May | 241/264 X |

FOREIGN PATENT DOCUMENTS

| | | | |
|---|---|---|---|
| 32636 | 8/1885 | Fed. Rep. of Germany . | |
| 630331 | 3/1962 | Fed. Rep. of Germany . | |
| 1507567 | 4/1969 | Fed. Rep. of Germany . | |
| 1757954 | 6/1971 | Fed. Rep. of Germany . | |
| 2722625 | 12/1977 | Fed. Rep. of Germany . | |
| 7731790 | 3/1978 | Fed. Rep. of Germany . | |
| 209077 | 4/1984 | German Democratic Rep. . | |
| WO84/01616 | 4/1984 | PCT Int'l Appl. | 241/264 |
| 934197 | 8/1963 | United Kingdom | 241/267 |

OTHER PUBLICATIONS

Westfalia Lunen, 6–79.

*Primary Examiner*—Mark Rosenbaum
*Attorney, Agent, or Firm*—Mark T. Basseches; Paula T. Basseches

[57] ABSTRACT

A jaw crusher is equipped for the first time with a horizonal crushing chamber and, for replacement of gravity for the conveyance of the material being crushed through the crushing chamber, with an abutment comprising a chain conveyor. The mechanism for applying the crushing force on the jaw rocker (10) is selected so that the action is equivalent to that of a double bell-crank jaw crusher even for hardest material and in particular for recycling material such as reinforced concrete.

2 Claims, 4 Drawing Sheets

JAW CRUSHER

Figure 1:
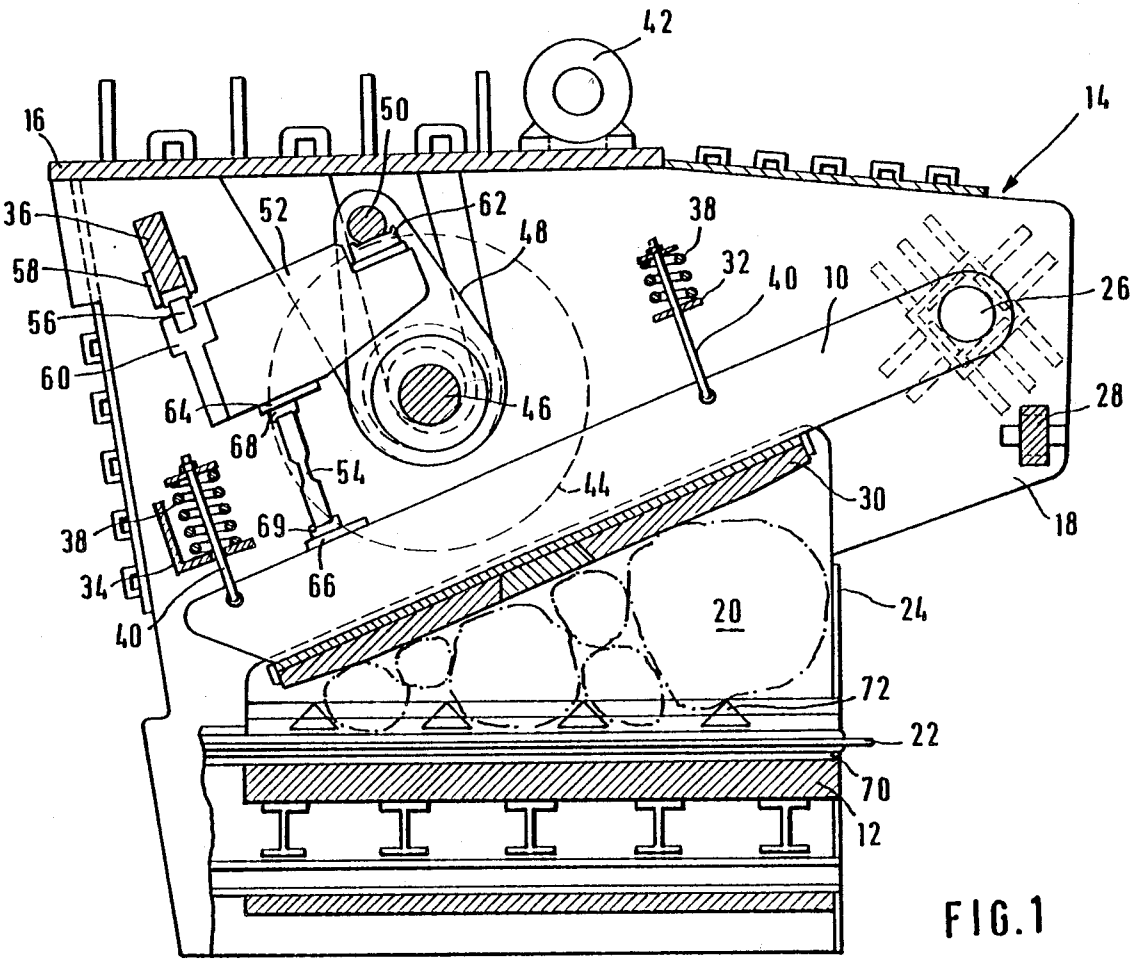

The invention relates to a jaw crusher having a crushing jaw pivotably mounted at one end, a crushing stroke drive acting on the backside of the crushing jaw away from the crushing chamber, and an anvil serving as abutment for the pressure-crushing of the material to be processed by the crushing jaw, which anvil forms with the crushing jaw a crushing chamber narrowing in material flow direction.

Jaw crushers of this kind are known. They involve sturdy structures which, in particular when designed as double bell-crank jaw crushers, are suitable for the processing of even hardest rock. The known jaw crushers are charged from the top and have a vertical material flow direction from the top down. The crushing chamber narrows in wedge form downwardly. The supplied material to be crushed is pressed through the one, swingingly arranged jaw against the other, fixed jaw. Through the compressive stress the material is broken up in several steps and finally falls out of the crushing chamber by gravity.

The known jaw crushers are complicated and expensive to manufacture. Yet they are not suitable for all types of use. Thus, in particular they are hardly suitable for the recycling of reinforced concrete parts. Also they tend to malfunction due to clogging, wedging and jamming of the material to be broken. Steel parts entrained in the recycling must often be removed with cutting torches. The clogging and the manual cleaning out necessitated thereby also increases the danger of accidents.

Known also are tup crushers where a tup revolving about a horizontal shaft with beating strips arranged on its circumference is disposed in the housing over a chain conveyor on which the material to be broken is supplied to it. Such tup crushers are suitable only for breaking up at most medium hard rock. If stone of any kind is supplied to them, including for example reinforced concrete for recycling, too rapid a wear of the beating tools will occur. With such machines, therefore, profitable crushing of the whole range of occurring material is not possible.

It is the object of the invention to improve the known jaw crusher, while maintaining its advantages with respect to insensitivity, low wear and workability of even hardest rock, in such a way that it is usable in many ways also for the recycling and crushing of reinforced concrete and, when clogged, can be cleared mechanically instead of manually.

According to the invention, this problem is solved in that (a) the crushing chamber is disposed horizontally, (b) the anvil defining the bottom of the crushing chamber consists of an at least nearly horizontal chain conveyor with breaking strips extending perpendicular to the transport direction and protruding into the crushing chamber, which (strips) are solidly supported as abutment on their underside, and (c) the crushing jaw defining the top of the crushing chamber is designed as a rocker whose rocking shaft lies over and, in transport direction before, the inlet mouth of the crushing chamber.

It is seen that here for the first time the known jaw crusher, while maintaining its typical pressure-crushing between a movable crushing jaw and an anvil, is arranged tilted 90° in such a way that the crushing chamber tapering in material flow direction lies horizontally. Here gravity can no longer be used to convey the material through the crushing chamber. Therefore, a chain conveyor is provided which draws the material on the anvil into the crushing chamber. The chain conveyor is provided furthermore with crushing strips which lie perpendicular to the jaw serration and thus lead to transverse breaking of the lumps of rock and support the crushing of the material under the action of the movable jaw. Besides, the crushing strips can easily be exchanged, not only in case of wear, but also for retooling to a strip form which best corresponds to the particular material. It is obvious that now, in case of clogging, the material can be conveyed back in the crushing chamber or even out of the crushing chamber mechanically by reversal of the conveyor drive, so that the hitherto frequent malfunctions in jaw crushers due to clogging, wedging and jamming of the material in the crushing chamber can be eliminated mechanically in a simple manner. The danger of accidents is reduced accordingly. The crushing jaw is designed as a rocker whose rocking shaft lies over and in transport direction before the inlet mouth of the crushing chamber. This is a compact design which furthermore in no way impedes the supply of the material to the crushing chamber. By the mere pressure-crushing of the material under the action of the jaw rocker, not only the processing of hard rock, as in conventional jaw crushers, but also the breaking of reinforced concrete is possible, because iron-reinforced ties and masts of any length can be supplied and broken, with the iron bars usually remaining straight, which is important for re-use, and neither destroying nor clogging the crushing chamber. Naturally also the discharge of the material from the crushing chamber occurs through the chain conveyor.

Only for difficult material the chain conveyor is operated intermittently. In this case it is especially advantageous if the drive of the chain conveyor and the drive of the jaw rocker are matched so that when the jaw rocker is activated, the chain conveyor stands still, while on the other hand the feed stroke of the chain conveyor occurs during the return stroke of the jaw rocker and the resultant release of the material by the jaw rocker.

Naturally also in this new jaw crusher it is expediently provided that the wear parts are exchangeable. Thus, the jaw rocker may consist of a rocker base element with crushing jaw made exchangeable as wear part. Also at the anvil wear plates are expediently used which can be exchanged.

It is of special importance to give the above explained new model of a jaw crusher suitable for recycling, a drive which as to performance is equivalent to the double bell-crank drive. According to the invention, a conventional drive unit with drive motor, eccentric shaft, and external flywheels is used, which expediently is mounted as a closed unit on the back of the jaw rocker on the back wall, here lying at the top, of the housing. A determining factor now is that the drive of the jaw rocker occurs through a shift lever which at the top is supported at one end on a cross beam of the housing through a supporting bearing bushing, is provided at the top at the other end with a power input bearing bushing for power input from the connecting rod running on the eccentric shaft and at the bottom at an intermediate point with a sliding bearing for one end of a pressure plate, the other end of which acts for transmission of the crushing stroke on the jaw rocker on the back thereof. The pressure plate is formed in the usual manner as a safety pressure plate with a weakening point which constitutes an overload protection.

A great advantage also resides in the fact that the intermediate point of engagement of the shift lever is formed at one end of the pressure plate, while the engagement point of the other end of the pressure plate on the jaw rocker is displaceable parallel to vary the crushing stroke. For this purpose appropriate guides may be provided at the shift lever or respectively on the back of the jaw rocker. This parallel displaceability makes the distance from the rocking shaft of the jaw rocker and hence the crushing stroke adjustable. Thus, for material easy to process the throughput can be increased by a greater crushing stroke, while for difficult and especially hard material an adaptation to such material can occur by reduction of the crushing stroke.

Adjustable also is the distance of the intermediate point, i.e. the point of power input into the pressure plate, from the point of engagement thereof on the jaw rocker. This can be achieved by different lengths of the pressure plates. But especially expedient is the possibility of inserting spacer plates. In this manner the shift point can be varied and the gap width in the crushing chamber adjusted.

Expediently, springs operative in the direction of the return stroke of the jaw rocker and supported on the housing engage at said rocker. Thereby all parts of the power input are permanently held together under spring force but need not be coupled mechanically. This simplifies the design.

The crushing strip chain conveyor is elastically tensioned in transport direction through one of its guide pulleys. This can take place through cup spring packets and spindles or hydraulically. It is thereby ensured that during the crushing stroke the chain conveyor is not damaged by the strong forces acting on it through the crushing strips. The chains should expediently run in the anvil in sectional tracks and hence under protection.

In the drawings the invention is explained with reference to an embodiment, showing:

FIG. 1 in section, a first embodiment

Figure 2:
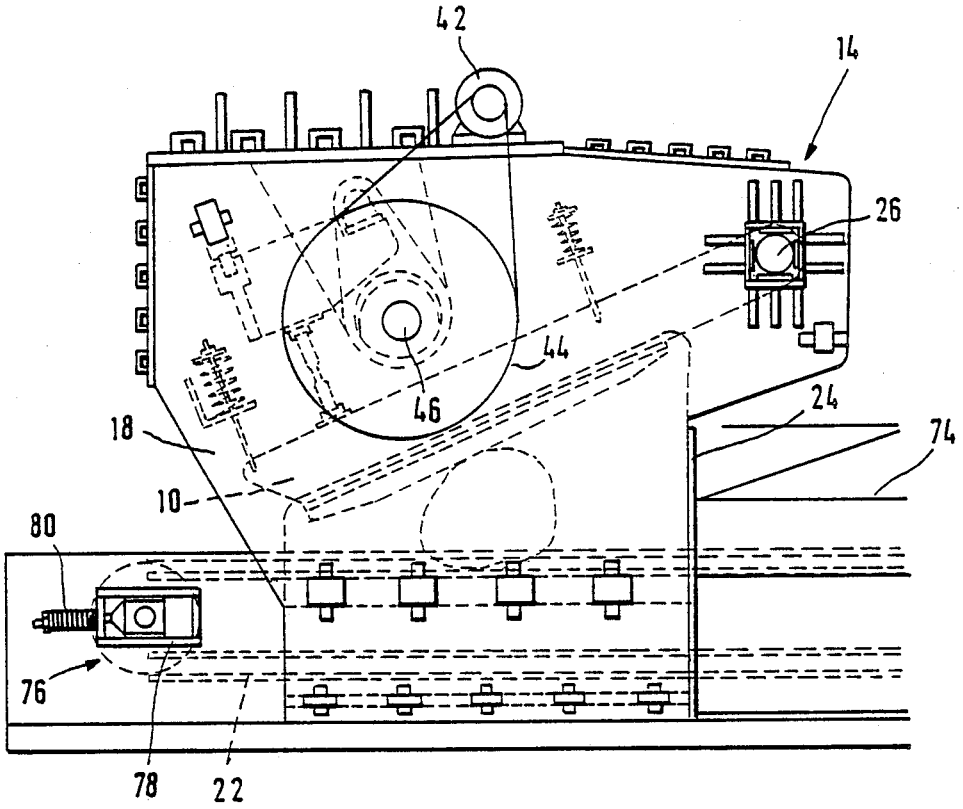

FIG. 2 a side view of a second embodiment, and

Figure 3:
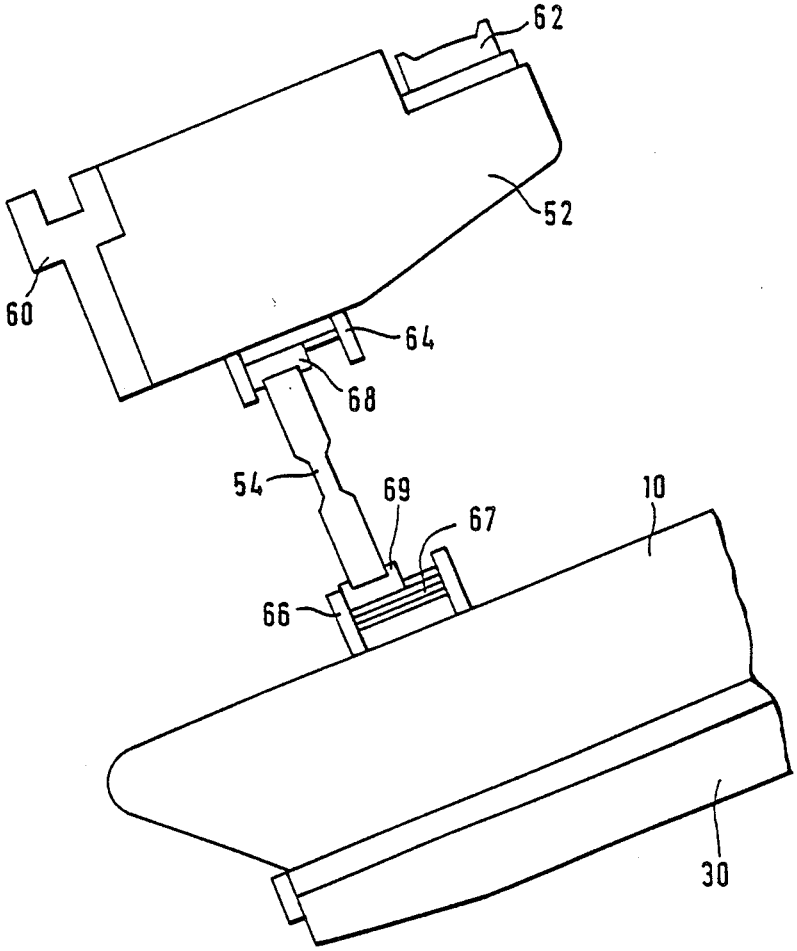
Figure 4:
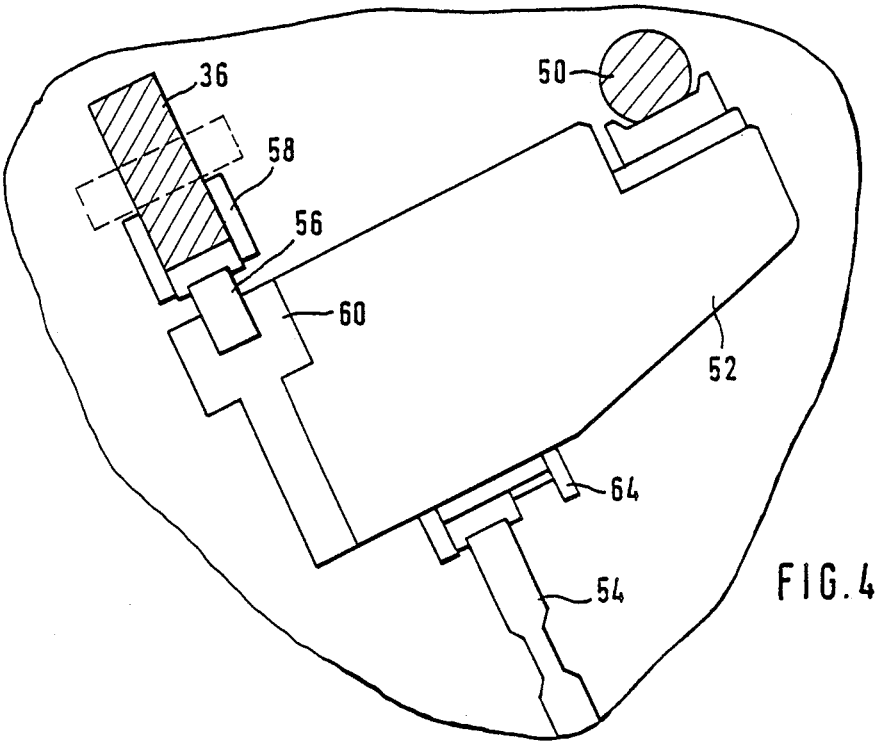
Figure 5:
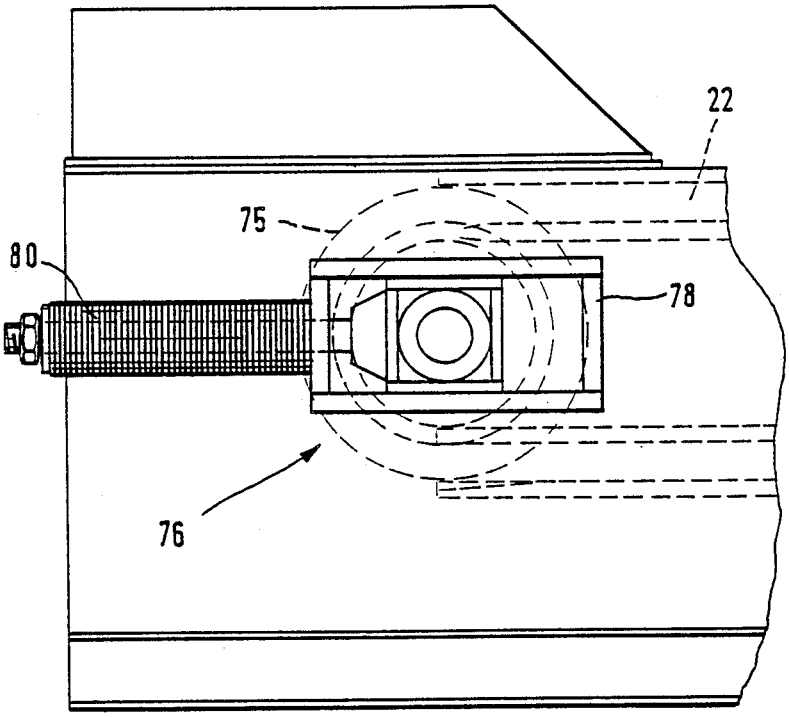

FIGS. 3–5 on a larger scale, details of the mechanism, of its housing support, and of the chain conveyor tension.

The jaw crusher consists essentially of a jaw rocker 10 and an anvil 12 constituting the fixed jaw, which consists of a housing 14 of front wall (=anvil 12), back wall 16 (here lying at the top) and side members 18.

The crushing chamber 20 between jaw rocker 10 and anvil 12 tapers in transport direction of the chain conveyor 22 from the inlet mouth 24 to the outlet gap. High above the inlet mouth 24 and in transport direction before it, the rocking shaft 26, lying perpendicular to the transport direction, of jaw rocker 10 is arranged transversely of the housing. The rocking shaft suspension of jaw rocker 10 at housing 14 is a maintenance-free roll-off suspension with limiting plates. In the region of the rocking shaft 26, that is, above the inlet mouth 24, moreover the side members 18 are connected by a cross bracing 28. Starting from the rocking shaft 26, the jaw rocker 10 runs obliquely downward under an angle of about 30° relative to the horizontal. The rocker base element of jaw rocker 10 consists of a ribbed steel plate. The actual crushing jaw 30 is exchangeably clamped on the rocker base element facing the crushing chamber 20.

The side members 18 of housing 14 are further connected in the space between back wall 16 and the back of jaw rocker 10 by a flat support plate 32, a supporting bracket 34 of L-shaped cross section, and by a solid cross beam 36. The support plate 32 and support bracket 34 are disposed so that their support faces are approximately parallel to jaw rocker 10. They serve to support helical springs 38 at housing 14, which are connected to jaw rocker 10 through tie rods 40. In this manner the jaw rocker 10 is acted upon by the helical springs 38 through the tie rods 40 in the direction of the back wall 16 in the direction of enlarging the crushing chamber 20. The actual crushing stroke of the jaw rocker 10 thus occurs counter to the action of the helical springs 38, while the return stroke is supported by the helical springs. The helical springs 38 serve to keep all parts of the drive in permanent contact with one another.

The drive of jaw rocker 10 consists in conventional manner of a drive motor 42, flywheels 44 disposed outside the side members, and an eccentric shaft 46. The entire drive unit consisting of these parts is mounted fixed on the back wall 16, lying at the top, of the jaw crusher. For assembly or repair, therefore, the complete drive unit can be installed or handled separately. Connected to the eccentric shaft 46 is a connecting rod 48 which transforms the eccentric revolving motion into a reciprocating stroke motion of a connecting rod 50 parallel to the eccentric shaft 46 (sectioned in FIG. 1). The eccentric shaft 46 and connecting rod 48 are mounted in self-aligning rollers.

For the transformation of said reciprocating motion of the connecting rod 50 into the crushing stroke of the jaw rocker 10 a shift lever 52 is provided, which engages on the pressure side of jaw rocker 10 through a pressure rod 54. The pressure rod 54 or respectively its line of action, the connecting line of the geometric axes of the eccentric shaft 46 and of the connecting rod 50, the tie rods 40, as well as the axis of the cross beam 36 of rectangular cross section are all approximately parallel to each other and perpendicular to the tangent of jaw rocker 10 on the material being crushed, indicated in dash-dot lines in the crushing chamber 20.

At its left upper end in FIG. 1, the shift lever 52 is supported on the housing 14 through a small pressure rod 56 and a fork 58 which supportingly embraces the large side faces of the cross beam 36. To this end the shift lever 52 is provided at its upper left end with a support bearing bushing 60 which embraces the lower end of the small pressure rod 56. While little mobility exists here, it is here that essentially the housing-fixed and stationary support point of the shift lever 52 is located.

Essentially at the same level above the jaw rocker 10 but at the farthest cantilevered right upper end of the shift lever 52, the latter carries a power-input bushing 62 by which it engages the connecting rod 50 from below. This, therefore, is the point of power input from the drive unit into the mechanism (FIG. 4).

The shift lever 52, which by the way has the special form shown in the figure, further comprises, at an intermediate point lying with respect to the above explained direction of action between the housing support in the support bearing bushing 60 and the drive connection in the power input bushing 62, a guide 64 to which there corresponds a parallel guide 66 on the back of jaw rocker 10. The mutually parallel guides 64 and 66, of course, lie perpendicular to the direction of action. The guides 64 and 66 have sliding bearing bushings 68, 69 provided in them, in which the pressure rod 54 is adjusted. The pressure rod 54 as overload protection is provided with a weak point in the manner shown. By displacing the sliding bearing bushings 68, 69 along the guides 64 and 66, the lever arm and hence the crushing stroke can be adjusted. In addition, by the length of the safety pressure rod 54, but expediently by spacer plates 67 inserted under the sliding bearing bushings 69 (FIG. 3), also the deflection point and hence the gap width at the crushing chamber 20 can be varied in a simple manner.

The sliding bearings at the support bearing bushing 60, at the power-input bushing 62 and at the sliding bearing bushings 68, 69, respectively, require no maintenance. All parts are, moreover, clamped in the above explained manner by the tie bars formed by the helical spring 38 and the tie rods 40 engaging at the jaw rocker 10. Obviously the shift lever system with the preassembled bearing bushings can be installed as a unit as well.

The infrastructure of the jaw crusher (corresponding to the end wall in the conventional model) has as resistance plate the anvil 12. The latter is constructed in an adequately sturdy design, as can be seen in the figure. On its top side the anvil 12 is covered with wear plates and comprises furthermore sectional tracks 70 lying in transport direction of the chain conveyor 22, in which (tracks) the actual chains of the chain conveyor are guided under protection.

Forming part of the anvil 12 are also the crushing strips 72, which in each instance are connected at one end to one of the two chaings of the chain conveyor 22. The crushing strips 72 are shown in FIG. 1 with a cross section in the form of an equilateral triangle. But it is obvious that the cross-sectional form of the crushing strips can be adapted to the material being crushed. The same applies to the number of crushing strips 72 connected to the chains. The crushing strips 72 are connected to the chain conveyor 22 easily exchangeable in the usual manner and there may be any desired number of them.

Preceding the inlet mouth 24 of the jaw crusher is a charging basin 74 of appropriate length, of which FIG. 2 shows only the crusher mouth-side end. Obviously the crushing strip chain conveyor 22 extends over the full length of the charging basin 74 and serves therein as a kind of scraper bottom for feeding material to the jaw crusher.

Further it is important that the chain conveyor extends not only up to the end of the jaw rocker 10 farthest away from the rocking shaft 26. For in view of the horizontal arrangement of the crushing chamber 20, the crushing strip chain conveyor 22 must evacuate the material also from the crushing chamber 20 to the left and carry it away to a discharge. For this reason the chain conveyor 22 extends in transport direction beyond the crushing chamber 20, up to its discharge end 76, as can be seen in FIG. 2.

The two lateral chains of the chain conveyor 22 are passed at both ends over guide pulleys 75. The guide pulleys 75 consist of a drum with sprocket wheels provided at both drum ends over which the chains are passed. These sprocket wheels are expediently moved into the side members.

FIGS. 2 and 5 show that the guide pulley 75 is movable at the discharge end 76 in transport direction, that is, in horizontal direction, and is under elastic tension. For the discharge of material at the discharge end 76 this is no obstacle because the respective horizontally movable sliding bearings 78 and the respective spring packets 80 can also be accommodated in the side members. The spring packet 80 may be a cup spring packet. Instead, of course, hydraulic tension is possible also. What matters is that due to the elasticity on the one hand the chain conveyor 22 is always kept tensioned, but can, on the other hand, yield under the action of the crushing stroke via the material being crushed and the crushing strips 72 on the chain conveyor 22 if necessary, so that it always remains undamaged and operational.

The drive of chain conveyor 22 is not shown in the figure. In fact, for reasons of space it is expediently arranged at the other end of the charging basin so as to engage at the guide pulley located there. The drive of chain conveyor 22 is expediently intermittent, step by step. An especially appropriate procedure is to let the chain conveyor 22 stand still when the jaw rocker 10 exerts the crushing force on the material present in the crushing chamber 20, which force must be absorbed by the anvil 12 and in so doing of course acts also on the crushing strips 72 connected with the chain conveyor. On the other hand, when the jaw rocker 10 lifts off the material during the return stroke, new material can be fed into the crushing chamber 20 again by the chain conveyor 22.

Of special importance is also the fact that, due to the chosen design of the jaw crusher with horizontal crushing chamber, the material can be transported back again out of the crushing chamber 20 into the charging basin 74 counter to the transport direction. All that this requires is to reverse the electric motor provided for the chain conveyor drive. Clogging, wedging and jamming of the material in the crushing chamber 20 can thus be cleared up mechanically.

Instead of the drive of the chain conveyor by electric motor, it can of course be given a hydrostatic or hydrodynamic drive. Clutches and transmissions are provided as needed.

The end wall forming the anvil 12 is detachably connected with the housing 14 and can be exchanged, if needed, for the usual fixed crushing jaw. With appropriate layout of the housing 14, therefore, both a conventional jaw crusher with vertical crushing chamber and the jaw crusher according to the invention with horizontal crushing chamber can be realized with one and the same design.

Having thus described the invention and illustrated its use, what is claimed as new and is desired to be secured by Letters Patent is:

1. A jaw crusher device adaptable to provide both a vertical and a horizontal crushing chamber comprising a housing including spaced pairs of generally vertical side walls, end walls linking said side walls, a crushing jaw mounted in said housing, pivot means adjacent an upper end portion of one said pair of said walls supporting said jaw for movement about a horizontal pivot axis, an anvil detachably connected to said housing and disposed perpendicular to said side and end walls, said anvil defining with said crushing jaw a progressively narrowing crushing chamber, said chamber being generally horizontally arrayed when said anvil is in a horizontal plane and narrowing in a downward direction when said housing is bodily rotated 90° whereby said anvil is generally vertically disposed, transport means removably mounted over and supported on said anvil in the horizontal position thereof, said transport means including triangular crushing strips, drive means for shifting said transport means across the surface of said anvil in the narrowing direction of said crushing chamber, jaw drive means for pivoting said crushing jaw toward and away from said anvil, said side walls including first support surface means for supporting said housing with said anvil in a horizontal disposition and second support surface means for supporting said housing in said bodily rotated position whereby said device is adapted to provide a horizontal and a vertical crushing chamber selectively in accordance with which of said first and second support surface means is disposed in supporting relation of said housing.

2. Apparatus in accordance with claim 1, wherein said transport drive means is intermittent and coordinated with said jaw drive means to render said transport means stationary during movements of said jaw toward said anvil and to shift said transport means in said direction during movements of said jaw away from said anvil.

* * * * *